United States Patent [19]

Ekstroem

[11] 4,083,208

[45] Apr. 11, 1978

[54] APPARATUS FOR THE WET TREATMENT OF TEXTILES

[76] Inventor: Carl Lennart Ekstroem, Soersmarksilden 21, Boras, Sweden

[21] Appl. No.: 703,805

[22] Filed: Jul. 9, 1976

[30] Foreign Application Priority Data

Jul. 10, 1975 Germany ..... 2530915

[51] Int. Cl.[2] ..... D06B 5/14

[52] U.S. Cl. ..... 68/181 R; 68/178

[58] Field of Search ..... 68/177, 178, 62, 175, 68/181 R, 184, 200, 205 R, 207, 212, DIG. 1, 179; 8/152, 151.2; 28/1.4, 1.6; 26/21; 118/405, 419, 420; 134/64 R, 64 P, 122 R, 122 P, 182, 183, 9, 15; 354/321, 322, 324; 57/34 B

[56] References Cited

U.S. PATENT DOCUMENTS

| | | | |
|---|---|---|---|
| 2,085,842 | 7/1937 | Wentworth | 68/DIG. 1 |
| 2,150,679 | 3/1939 | Frusher | 26/21 |
| 2,899,265 | 8/1959 | Griset | 8/152 X |
| 3,482,294 | 12/1969 | Joly | 28/1.6 |
| 3,493,321 | 2/1970 | Inoue et al. | 68/177 X |
| 3,599,447 | 8/1971 | Arashi | 68/177 |
| 3,659,438 | 5/1972 | Chiba et al. | 68/177 |
| 3,696,645 | 10/1972 | Henningsen et al. | 68/177 |
| 3,952,558 | 4/1976 | Sandberg et al. | 68/177 |

*Primary Examiner*—Philip R. Coe
*Attorney, Agent, or Firm*—Paul L. Sjoquist

[57] ABSTRACT

The invention relates to a pressure vessel for use in the wet-treatment of textiles, for example dyeing, which is provided with a horizontally disposed drive nozzle having an undulating discharge pipe. In examples of apparatus the pipe is provided with perforations in a lower part of the pipe wall and/or is connected to a dwell chamber within the vessel.

5 Claims, 5 Drawing Figures

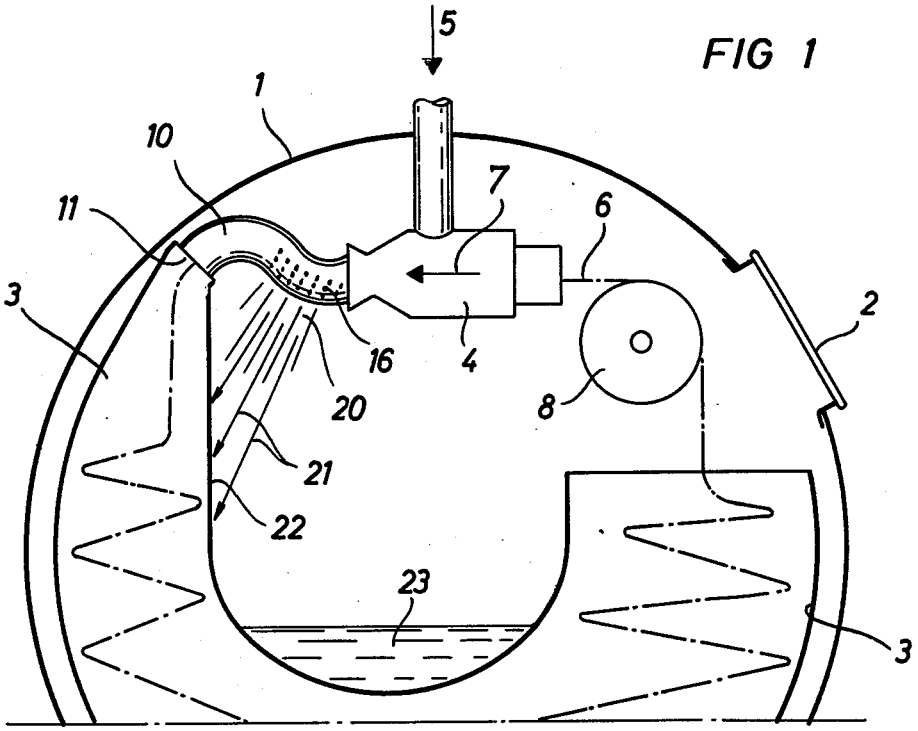
FIG 1
FIG. 2
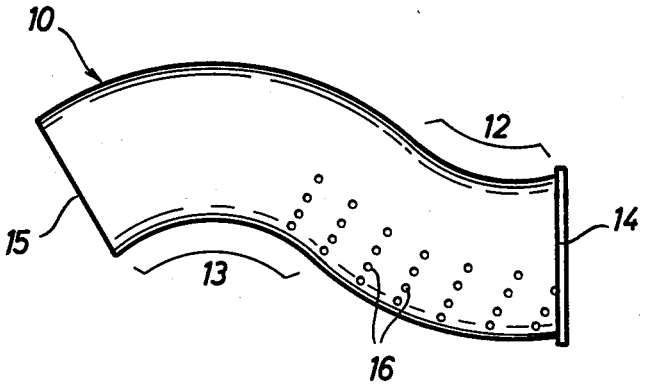

APPARATUS FOR THE WET TREATMENT OF TEXTILES

BACKGROUND OF THE INVENTION

This invention relates to apparatus for the wet treatment of textiles, in endless rope or web form, particularly, but not exclusively, for the dyeing of textiles in a partly filled vessel.

There are in existence various types of so-called jet-dyeing machines which mostly are operated at high temperature. The feed jets of these machines in certain of these machines are arranged inside the pressure vessel. However textiles of greatly varying character have to be dyed with the dyeing machines and it has been found that the feed jets do not always confer sufficiently high quality and uniformity of dyeing to the textile material. In this connection it has to be noted that in many rope-dyeing machines not only is it required to dye ropes of natural fibres, but also textile material by the length which may vary considerably in thickness, and may be on man-made materials.

BRIEF SUMMARY OF THE INVENTION

It is an object of the invention to provide means whereby wet treatment of different materials can be carried out in the same type of machine without modification of the machine and the quality of the dyeing of the different materials can be improved.

The invention therefore provides apparatus for the wet-treatment of textiles comprising a pressure vessel, at least one drive nozzle mounted horizontally or substantially so at an upper region within the vessel, and a discharge pipe leading from said nozzle, said discharge pipe having an undulating form. It will be appreciated that the undulating form of this discharge pipe increases the turbulence downstream from the driving nozzle and thus assists the movement of the textile.

In a preferred example of the invention, the centre line of the undulating pipe may be in a vertical or substantially vertical plane.

The discharge pipe may have at the end thereof remote from the driving nozzle a smaller cross-sectional area than at the part thereof adjacent the nozzle.

Advantageously, there are provided a plurality of apertures in a portion of a wall of the discharge pipe which faces the lower region of the vessel.

In accordance with a preferred embodiment of the invention the discharge pipe is provided with the apertures solely at the zone thereof adjacent the nozzle and directed towards the lower region of the pressure vessel; these holes bring about a considerable loss in rate of travel and thus of energy downstream from the driving nozzle but at least partially oppose the aforementioned turbulence and this in turn leads to a calming of the movement of the rope downstream from the driving nozzle without the laying out thereof being impaired. Since the rope dyeing machine can also be used for a final rinsing of the dyed textile material, the separation of the more heavily contaminated flushing water, or that carrying lint, can be catered for by the arrangement of the holes. This flushing liquid then flows away through a chamber via an overflow and is not then, as has been the usual case in the past, fed into the circulatory system of the treating medium.

The calming action or energy loss contributes, particularly in the case of textile fabrics of man-made fibres, to the effective elimination of any deformations, for example such as permanent crinkling or the like; such crinkling occurs for example in the case of rope dyeing machines which include a pipe directed against a so-called rebound plate. The arrangement of the apertures in the pipe has been found effectively to eliminate, in this type of rope dyeing machine, deformations of the man-made fibres or the woven or knitted fabric of such fibres.

BRIEF DESCRIPTION OF THE DRAWINGS

There will now be described examples of apparatus according to the invention. It will be understood that the description, which is to be read with reference to the accompanying drawings, is given by way of example only and not by way of limitation.

In the drawings:

FIG. 1 is a diagrammatic partial section through a rope dyeing machine including apparatus in accordance with the present invention; and FIGS. 2 to 5 illustrate various alternative forms of the discharge pipe, in each case in longitudinal section.

DETAILED DESCRIPTION OF THE DRAWINGS

Figure 3:
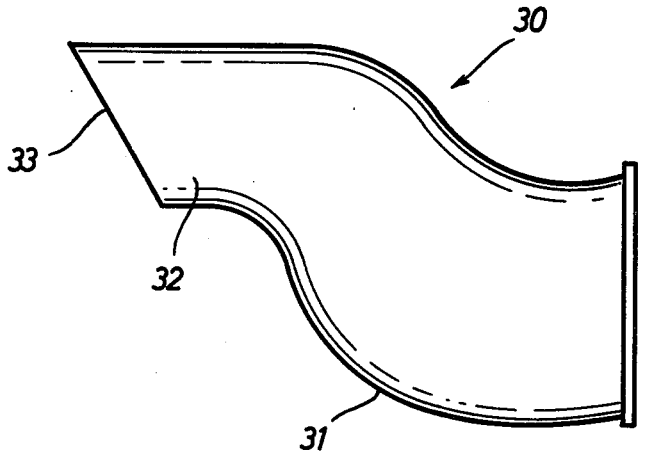

A cylindrical pressure vessel 1 is provided with inspection ports 2 and in the present instance three dwell chambers 3 of stirrup form arranged one behind another. Arranged in the upper part of the pressure vessel 1 is a feed or driving nozzle 4; two further feed or driving nozzles of a like kind, and depending in number to that of the dwell chambers, are provided in the pressure vessel.

The driving nozzles 4 are supplied in the direction of arrow 5 with the treating medium and act on the rope 6 in the direction of arrow 7. The direct dyeing and simultaneous driving of the rope occurs in the zone of the driving nozzle.

The rope used can be of any desired textile material, thus for example including material by the length; depending on the thickness or weight of the textile material used, 600 to 1,000 meters connected so as to form an endless rope are treated in a dwell chamber with an appropriate driving nozzle.

The textile material is fed from the dwell chamber to the driving nozzle 4 by means of a winch 8. From the driving nozzle the rope 6 passes into a pipe 11 the mouth of which opens into chamber 3.

FIG. 2 shows the pipe illustrated in FIG. 1 on a larger scale. The pipe illustrated may for example have a diameter of 12.5 cm and is curved at zone 12 with a radius of 22.5 cm, whilst the curvature in zone 13 is of approximately the same radius.

The pipe is of constant cross section throughout, that is to say from the inlet 14 to mouth 15.

Apertures 16 are provided in the lower part of the pipe. In the embodiment illustrated there may for example be 196 holes with a diameter of 9 mm and spaced at 14 mm from one another in fourteen rows.

Whilst the knee-like curvature of the pipe can advantageously be formed in a vertical plane, even if the knee-like bends are orientated in different directions, the apertures 16 will advantageously in certain examples be provided only in the regions in which the path of the rope descends.

Where the driving nozzle 4 is to be used for example for rinsing, the rinsing medium leaves the textile, as illustrated in FIG. 1, by partial spraying of the treating medium 20 in the direction of arrow 21; this treating medium emerging from the apertures 16 rebounds against the inner surface 22 of the dwell chamber 3 and is caught in a sump 23. The major part of the lint or other dirt removed by the rinsing will flow out through the holes 16 and float in the foaming part at the upper surface of the liquid in sump 23, and this dirt or contaminant material, particularly lint, can be discharged via an overflow provided (but not shown in the drawing) in the pressure vessel. Only the remaining relatively clean treating material will then be allowed back into the circulating medium.

In the case of the pipe 30 illustrated in FIG. 3 only one bend 31 is provided, and this merges into a horizontal pipe section 32, which in turn has an edge 33 which is bevelled relatively to the axis of the pipe.

The imperforate pipe illustrated in FIG. 3 is used exclusively for increasing the turbulence and for moving the fabric which for example is in rope form; this is particularly important where the edges of the fabric have become rolled-in in the zone of the nozzle. The curvature of the pipe brings about the movement referred to above so that the edges are partially inrolled.

Figure 4:
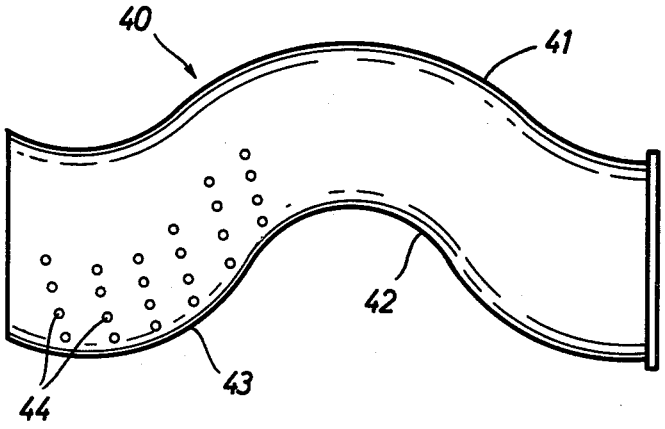

In the case of pipe 40 illustrated in FIG. 4, there are three successive curvatures. A pipe 40 of this nature would, inter alia, require a disposal of the driving nozzle 4 of FIG. 1 to the right, because this pipe 40 is, in the example, longer than the pipe 10.

Whilst the two curves 41 and 42 serve to increase the turbulence, a perforation is provided in the final curve 43 at the lower zone of the pipe 40, this comprising a predetermined number of rows of holes and is used to reduce the increased turbulence to separate the treatment medium in the manner described above, that is to say therefore that the major part of the treating medium accompanies the rope in the circulatory system, whilst a smaller portion is separated off through holes 44. The pipe 40 is of constant cross section throughout.

Figure 5:
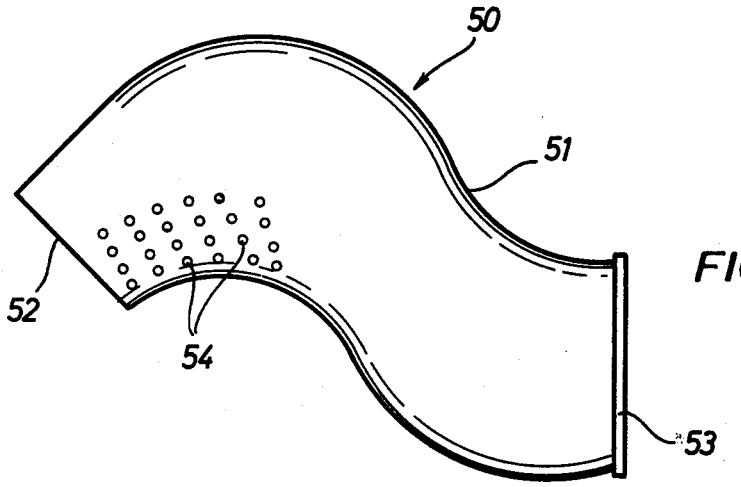

In the case of the pipe 50 of FIG. 5 only two curves are provided - as in the embodiment of FIG. 2 — but the cross-section of the pipe becomes of a funnel-type after the first bend 51 and is then reduced again so that the rim 52 of pipe 50 is of slightly smaller cross-sectional area than the mouth 53.

Apertures 54 are provided in the end part of pipe 50, namely in the lower part of the latter.

I claim:

1. Apparatus for the wet-treatment of textile goods in continuous strand form in circulation, comprising a pressure vessel having a first internal chamber for containing said textile goods and a second internal chamber for containing said wet-treatment;

a drive nozzle having an axis substantially horizontally positioned in said pressure vessel for feeding textile goods therethrough and for accepting said wet-treatment, and having an outlet for discharging said textile goods and said wet-treatment;

and a curved discharge pipe connected to said drive nozzle outlet and having an upward curved adjacent said nozzle outlet over the axis of said drive nozzle, the curve in said pipe being aligned in a vertical plane, said curved discharge pipe having a plurality of downwardly facing holes adjacent said drive nozzle outlet for directing said wet-treatment toward said second internal chamber in said pressure vessel, and having a discharge outlet end for directing said textile goods toward said first internal chamber in said pressure vessel.

2. The apparatus of claim 1, wherein said curved discharge pipe further comprises an outlet end of smaller cross-section than said connection to said drive nozzle.

3. An apparatus for the wet-treatment of textiles, comprising:

(a) a pressure vessel having an upper region for receiving textiles and a lower region subdivided into a first chamber for containing textiles and a second chamber for containing wet-treatment;

(b) a drive nozzle having an axis substantially horizontally positioned in said pressure vessel upper region for feeding textiles therethrough;

(c) a curved discharge pipe connected to said drive nozzle, said discharge pipe having at least one upward curve over the axis of said drive nozzle, said curve being aligned in a vertical plane, a plurality of apertures along a lower portion of said upward curve, said apertures opening into said pressure vessel second chamber, and said discharge pipe having an outlet end opening into said pressure vessel first chamber.

4. The apparatus of claim 3 wherein the discharge pipe has a remote end of cross-sectional area less than the cross-sectional area of the end connected to the drive nozzle.

5. The apparatus of claim 3 wherein the plurality of apertures are along a lower portion of the upward curve adjacent said driving nozzle.

* * * * *